US006135430A

United States Patent [19]

Bergman, Jr. et al.

[11] Patent Number: 6,135,430

[45] **Date of Patent: *Oct. 24, 2000**

[54] ENHANCED GAS DISSOLUTION

[75] Inventors: Thomas John Bergman, Jr., North Tarrytown; Jeffery Paul Kingsley, Newburgh, both of N.Y.; Mark Herbert Kirby, Ridgefield, Conn.; Mitchell Adis, North White Plains, N.Y.; Victor Alexander Coppola, Stamford, Conn.

[73] Assignee: Praxair Technology, Inc., Danbury, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/065,439

[22] Filed: Apr. 24, 1998

[51] Int. Cl.[7] ..... B01F 3/04

[52] U.S. Cl. ..... 261/93; 261/120; 261/121.1

[58] Field of Search ..... 261/77, 91, 93, 261/121.1, 120

[56] References Cited

U.S. PATENT DOCUMENTS

| | | | |
|---|---|---|---|
| Re. 32,562 | 12/1987 | Litz | 261/91 |
| 2,313,654 | 3/1943 | MacLean | 261/93 |
| 3,189,334 | 6/1965 | Bell | 261/93 |
| 3,547,811 | 12/1970 | McWhirter | 261/93 |
| 3,775,307 | 11/1973 | McWhirter et al. | 210/14 |
| 3,846,516 | 11/1974 | Carlson | 261/87 |
| 3,925,522 | 12/1975 | Schreiber | 261/92 |
| 4,290,885 | 9/1981 | Kwak | 261/93 |
| 4,681,711 | 7/1987 | Eaton | 261/91 |
| 4,735,750 | 4/1988 | Damann | 261/29 |

FOREIGN PATENT DOCUMENTS

| | | | |
|---|---|---|---|
| 2123732 | 9/1972 | France | 261/124 |
| 2734629 | 2/1979 | Germany | 261/120 |
| 1547115 | 6/1979 | United Kingdom | 261/91 |

*Primary Examiner*—David A. Simmons
*Assistant Examiner*—Robert A. Hopkins
*Attorney, Agent, or Firm*—Bernard Lau

[57] ABSTRACT

Oxygen or other gases are dissolved in large bodies of liquid by injection under a baffle for passage into a submerged hollow draft-tube-impeller means assembly for downward passage therein. Liquid containing dissolved gas is dispersed throughout the body of liquid, while any undissolved gas is effectively recovered and recycled.

12 Claims, 3 Drawing Sheets

ENHANCED GAS DISSOLUTION

BACKGROUND OF THE INVENTION

1. Field of the Invention

This invention relates to the dissolution of gases in liquids. More particularly, it relates to the oxygenation of large bodies of water.

2. Description of the Prior Art

Liquid waste destruction is commonly achieved at low cost by slurry-phase biotreatment processes in lagoons, surface impoundments and large tanks. In such processes, biological organisms, which may be either indigenous to the waste body or seeded therein from an external source, consume toxic, organic contaminants present in the waste body and convert them to less harmful substances.

For such biotreatment purposes, aerobic organisms are most commonly employed because, in general, they destroy organic contaminants much faster than anaerobic organisms. It will be appreciated that oxygen must be supplied to such processes in order to maintain a high contaminant destruction rate.

Surface aeration is a common oxygen supply method that can be used in slurry phase biotreatment operations. Such surface aeration is disclosed in the Haegeman patent, U.S. Pat. No. 4,468,358. In this approach, water is pumped from a waste body into the air for the entrainment and dissolution of oxygen therein. An effective oxygen transfer efficiency of approximately 1.9–2.6 lb/hp-hr can be achieved thereby. Surface aeration methods can cause severe foaming and, because they promote intimate contact between the waste material and the surrounding air, result in very high, undesirable organic chemical air emissions.

Air sparging is another common method for supplying oxygen to waste bodies for such biotreatment purposes. However, conventional air spargers typically result in the dissolution of only 5–10% of the oxygen injected into waste bodies thereby. Thus, for example, approximately 50–100 scfm of air must be injected into the waste bodies in order to dissolve 1 scfm oxygen. In addition, air sparging can cause unacceptable levels of organic chemical emissions as a result of the stripping action of waste oxygen and nitrogen on volatile compounds, when present in the waste bodies being treated. Severe foaming can also occur during air sparing operations.

If air is replaced by pure oxygen for biotreatment purposes, a much smaller feed gas volume is required to achieve the same dissolved oxygen level achieved by air sparging, and greatly reduced air emission levels result. However, most of the injected pure oxygen must be dissolved for such processing to be economical. In addition, the composition of any off gas must be outside the flammability limits of organic chemicals contained in the lagoon or other body of waste liquid.

Slurry phase biotreatment has been practiced, in a so-called Mixflo™ approach, by pumping a side stream slurry from a tank or lagoon and injecting pure oxygen therein. The resulting two phase mixture is then passed through a pipeline contactor where approximately 60% of the injected oxygen dissolves. The thus-oxygenated slurry and the remaining undissolved oxygen are then re-injected into the tank or lagoon by passage through liquid/liquid eductors. About 75% of the undissolved oxygen remaining at the eductor inlet is thereby dissolved, resulting in the overall dissolution of 90% of the injected oxygen. The pumping power required for this application is relatively high, i.e., having an effective oxygen transfer efficiency of about 2 lb/hp-hr.

The UNOX® Process is a surface aeration process using a pure oxygen-containing headspace. An effective oxygen transfer efficiency of 6.5–7.2 lb/hp-hr can be achieved using this process and system. This approach can cause severe foaming, and waste liquid must be pumped from a large tank or lagoon to an external tank reactor, treated therein, and returned to said large tank or lagoon. It is thus subject to appreciable pumping costs.

Two other approaches that likewise are carried out in covered, confined tank systems, are the Advanced Gas Reactor (AGR) and Liquid organic Reactor (LOR) processes and systems of Praxair, Inc. The AGR process and system, covered by the Litz patent, U.S. Pat. No. Re. 32,562, uses a helical screw impeller/draft tube assembly in a reactor to enhance the dissolution of oxygen from an overhead gas space. As the impeller turns, slurry is pumped through the draft tube so as to create, together with baffles positioned at the top of the draft tube, vortices in the pumped liquid, resulting in the entrainment of gas from the reactor headspace. Any gas not dissolved in a single pass through the draft tube is recirculated to the headspace and recycled. The AGR approach has an effective transfer efficiency of approximately 10 lb/hp-hr (standard transfer efficiency of 17–18 lb/hp-hr), and results in the dissolution of nearly 100% of the oxygen introduced into the system. It also ingests and destroys foam upon its passage through the draft tube.

The LOR process and system, covered by the Litz et al. patent, U.S. Pat. No. 4,900,480, is designed to safely dissolve oxygen in organic chemical-containing liquids. In certain embodiments, a horizontal baffle is positioned above the impeller/draft tube so as to provide a quiescent zone of liquid above the zone intended for gas-liquid mixing. Oxygen is injected directly into the impeller zone at a rate sufficient to sustain a high reaction rate, but low enough to maintain the oxygen level below the flammability limits of organic reactor contents. The LOR approach, like the AGR, consumes less power per pound of oxygen dissolved than pumping systems, the effective transfer efficiency of the LOR being approximately 10 lb/hp-hr.

Both the AGR and LOR approaches are carried out in covered, confined tank systems. Because of the tank requirements thereof and because of the additional foaming problems associated with the UNOX approach referred to above, further improvements in oxygen dissolution are desired in the art. Such improvements, in particular, are desired in light of the high power requirements associated with MIXFLO.

It is an object of the invention, therefore, to provide an improved approach to the dissolution of oxygen in liquids.

It is another object of the invention to provide a system for the efficient dissolution of oxygen in large liquid bodies.

With these and other objects in mind, the invention is hereinafter described in detail, the novel features thereof being particularly pointed out in the appended claims.

SUMMARY OF THE INVENTION

An impeller or impeller/draft tube assembly is covered by baffle means. These two elements are either supported or floated in a large liquid body. Gas, such as oxygen or carbon dioxide, is injected under the baffle and is ingested into the suction of the impeller. The system is employed without a confining outer tank for the liquid. Liquid rich in dissolved gas and any undissolved gas are discharged from the bottom of the draft tube. The undissolved gas floats toward the surface and is recovered by said baffle means for recirculation to the impeller or impeller/draft tube assembly. The liquid with dissolved gas distributes into the large liquid body.

BRIEF DESCRIPTION OF THE DRAWING

The invention is hereinafter described with reference to the accompanying drawings in which.

DETAILED DESCRIPTION OF THE INVENTION

The objects of the invention are accomplished by employing an efficient oxygenation system positioned in a lagoon or other large body of liquid. The system comprises downward pumping impeller means or an impeller/draft tube assembly positioned in said body of liquid, without a confining outer tank, and covered by a horizontal baffle or hood supported or floated in said body of liquid. Gas, such as oxygen, is injected into the body of liquid, as in the AGR or LOR approaches, with said gas being injected under the horizontal baffle or hood adapted to trap escaping undissolved gas. The gas is ingested, by the downward pumping impeller suction, into the downwardly passing liquid stream in the draft tube, for enhanced dissolution therein. The thus-gasified liquid, and any undissolved gas, are discharged from the bottom of the draft tube. While reference is made below to oxygen for convenience in describing the invention, it will be understood that oxygen is an illustrative example of the gases that can be dissolved in a large body of liquid in the practice of the invention.

Figure 1:
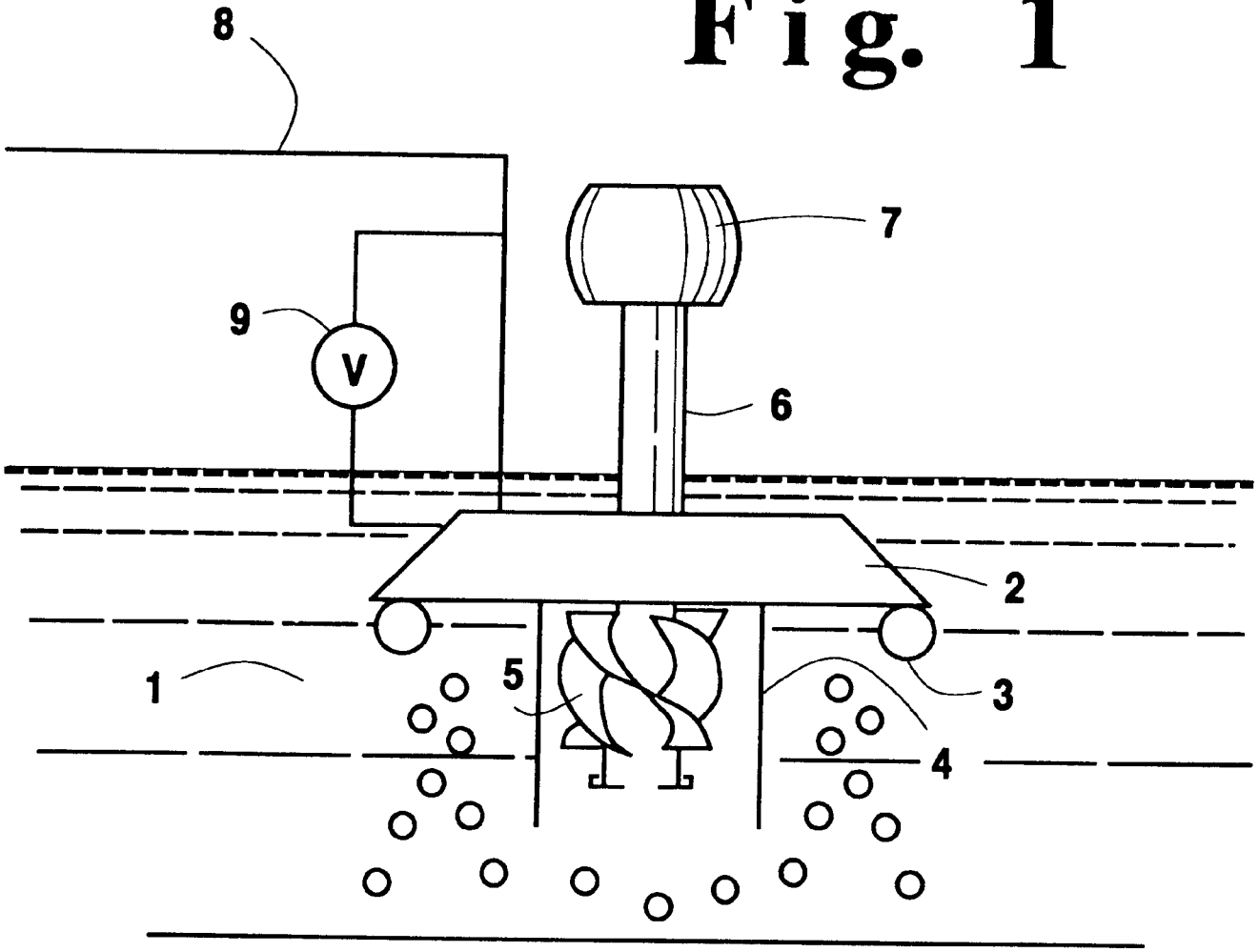
FIG. 1 is a schematic flow diagram of an embodiment of the invention, positioned in a lagoon or other large body of liquid.

As shown in FIG. 1 of the drawings, a large body of liquid, e.g., a lake, surface impoundment, tank, pond, lagoon or the like, is represented by the numeral 1 in which baffle means 2, conveniently horizontally positioned and commonly somewhat conical in shape, is positioned, as by floats 3. Hollow draft tube 4 is positioned under said baffle means 2 and has impeller means 5 located therein. Said impeller means 5 is driven by drive shaft 6 that extends upward above the water level of said body of liquid 1 and is driven by drive motor 7. Oxygen is injected into the body of liquid through line 8 adapted to inject the oxygen preferably under, or in the proximity of, baffle means 2 so as to be ingested into the suction of impeller means 5. Pressure tap 9 is provided so that the liquid level under baffle means 2 can be determined.

Oxygenated liquid and any undissolved oxygen are discharged from the bottom of draft tube 4. Oxygenated liquid passing from the draft is not recycled to the upper part of the draft tube for passage through impeller means 5, as in AGR and LOR systems, because of the absence of a confining outer tank in operation within a lagoon or other body of liquid 1. In such large liquid body applications, it is undesirable for the discharged liquid to recirculate to the impeller suction. If liquid discharging from the bottom of the draft tube were to recycle to the suction at the upper end of the draft tube, the dissolved oxygen would not readily disperse outward into the bulk liquid in the lagoon. Consequently, liquid in the impeller's zone of influence would have a very high dissolved oxygen level, and liquid away from this zone would be oxygen starved.

Any oxygen not dissolved in the liquid upon passing through the impeller zone in the draft tube rises close to the draft tube wall, e.g., in flow pattern 10, due to its buoyancy, is captured by conical-horizontal baffle means 2, and is channelled back into impeller means 5 within draft tube 4. The conical baffle is desirably adapted and is sufficiently wide to capture most of the undissolved oxygen, resulting in essentially 100% oxygen utilization in the practice of the invention. The oxygenated liquid discharged from the bottom of draft tube 4 flows outward into the body of liquid in flow pattern 11 so that the dissolved oxygen is readily dispersed throughout the body of liquid 1.

Figure 2:
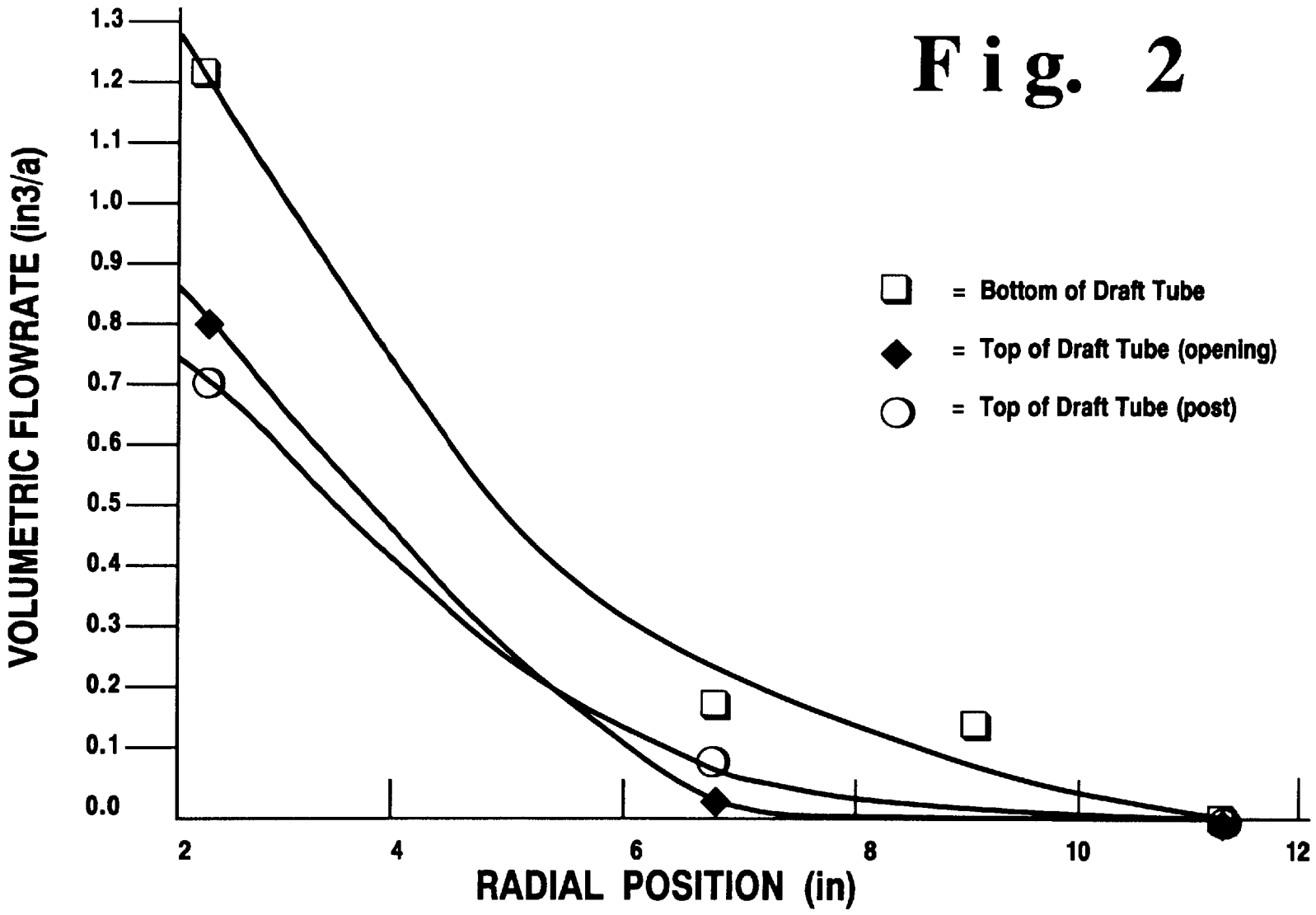
FIG. 2 is a plot of the radial gas distribution profiles at the top and bottom of a particular draft tube embodiment of the invention.

Radial gas distribution profiles were measured for a 3" diameter impeller means positioned in a hollow draft tube in embodiments of the invention. The results were as shown in FIG. 2 of the drawing in which the volumetric gas flowrate was plotted against radial position at the bottom of the draft tube, the top of the draft tube at the opening thereof and at the post opening thereof. The results demonstrated that the conical baffle size required to capture essentially 100% of the undissolved oxygen is relatively small. This is because of the absence of a reactor tank floor which, if present, would tend to enhance the radial dispersion of undissolved oxygen striking the tank floor. If a 24" diameter impeller were employed in an oxygenator operating, in the practice of the invention, at 290 RPM, a 72" diameter baffle would be sufficient to capture essentially all of the undissolved oxygen rising in flow pattern 10 close to the outside of draft tube 4, consistent with the FIG. 2 results showing that most of the undissolved oxygen exists at a short radial distance from the draft tube.

The standard oxygen transfer efficiency of the in-situ oxygenator of the invention was found to be 19.5 lb/hp-hr, which is equivalent to the standard efficiency of an AGR system and much higher than the transfer efficiency associated with sidestream pumping and surface aeration operations.

Figure 3:
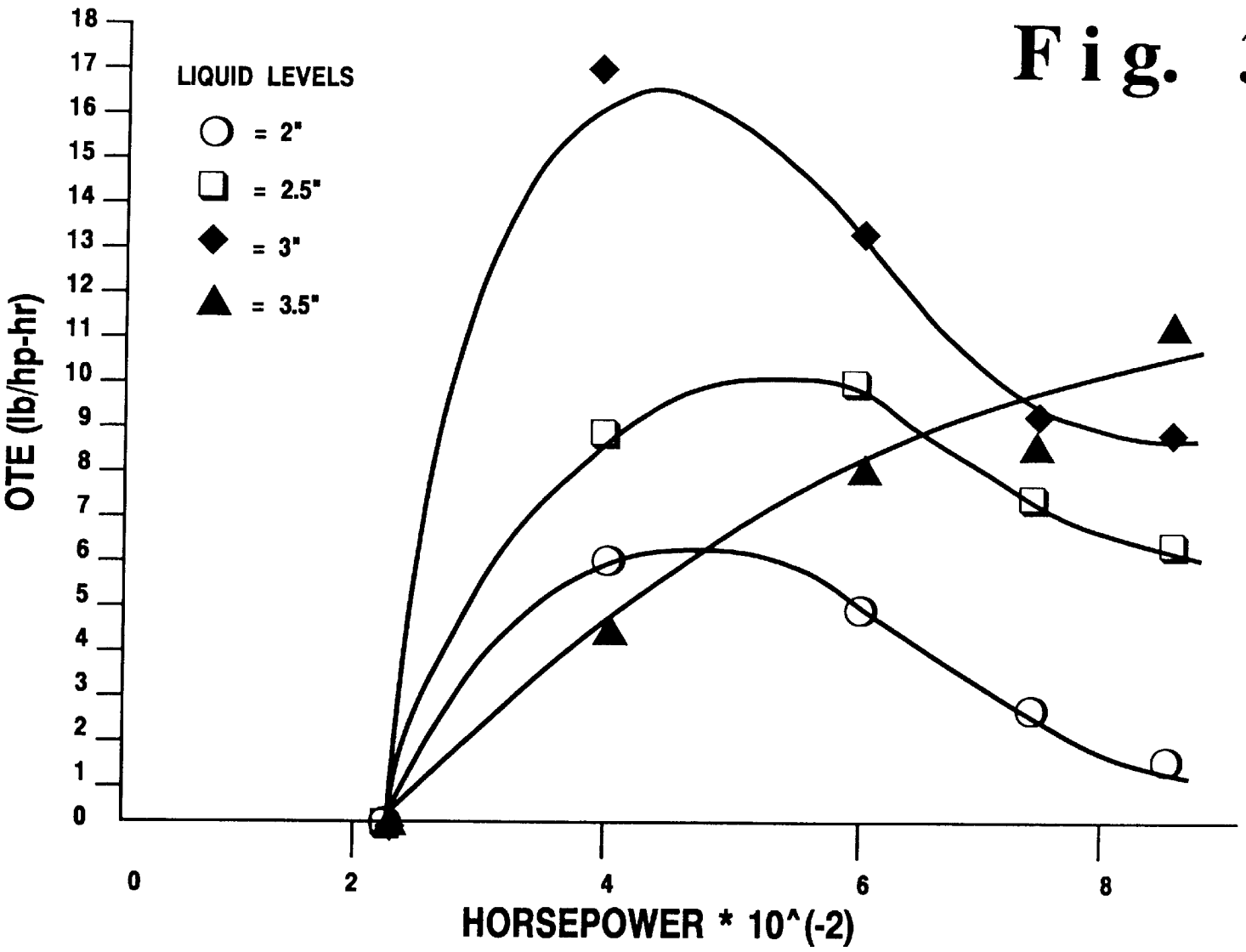
FIG. 3 is a plot showing the oxygen transfer efficiency per unit horsepower at various liquid levels in the in-situ oxygenator system of the invention.

It should be noted that the maintenance of a constant liquid level under the conical baffle can strongly impact the volume of oxygen dissolved per unit horsepower. Thus is indicated by the plot, in FIG. 3 of the drawing, of the oxygen transfer efficiency at various horsepower expenditure levels. It is desirable, in the practice of the invention, to have the liquid level monitored and maintained, e.g., on the basis of the pressure under the conical baffle. As the amount of gas under the baffle increases, the pressure under the baffle increases. The liquid level may be controlled, therefore, by increasing the oxygen injection rate if the pressure under the baffle falls below a predetermined set point, and by decreasing the oxygen injection rate if the pressure under the baffle exceeds the set point.

The oxygenation of the invention may also be used to control solids suspension in the liquid. The velocity and axial gas distribution characteristics of the oxygenator can be used to predict the solids suspension level achievable, or to avoid solids suspension altogether. This is a highly desirable aspect of the practice of the invention because, in biotreatment, too high a solids suspension level can poison the bacteria that consume organic contaminants in the body of liquid being treated.

Since the invention employs an impeller positioned in a draft tube, as in the AGR and LOR approaches, it is a foam consumer, thus eliminating the foaming concerns associated with the surface aeration approach. In addition, since organic chemicals are not sprayed into a gaseous headspace, organic stripping is minimal.

Those skilled in the art will appreciate that the invention can be used for the dissolution of from 21% oxygen, i.e. air, up to 100% oxygen, i.e., pure oxygen, assuming that the headspace under the horizontal baffle is vented to remove excess nitrogen. The invention can also be used to dissolve other gases, such as hydrogen, if so desired for particular water treatment purposes, or for the treatment of other liquids, e.g., organic liquids.

In addition to the biotreatment purposes referred to above, the in-situ oxygenator of the invention may be used to supply oxygen for municipal and industrial waste water treatment, fish farming and other applications involving a large body of water or other liquid.

It will be appreciated that various other changes and modifications can be made in the details of the invention without departing from the scope of the invention as recited in the appended claims. Thus, the baffle means employed is preferably a somewhat conical-shaped-horizontal baffle of sufficient width or size to capture most of the undissolved gas, but a variety of other baffle types and shapes may be positioned above or preferably below the surface of the liquid so long as they are adapted to capture and funnel most of the undissolved oxygen or other injected gas into the draft tube section of the gas dissolution system of the invention. For example, a plastic bubble or a flexible balloon canopy can be inflated by the use of a convenient injection device that can add as much gas as desired to the headspace under the canopy. Furthermore, the impeller means are desirably helical, axial flow, down pumping impeller means adapted to facilitate the downward flow of a gas-liquid mixture in the draft tube, but any suitable down-flowing impellers, such as a Lightnin A315® or Aire-$O_2$ Turbo®mixer can be employed to create the desired downward flow in the draft tube. It will be understood that the impeller means may also include additional features, such as a radial flow impeller means connected to the drive shaft to create a high shear zone in the draft tube to further enhance the dissolution of gas in the liquid.

The invention has been described above and illustrated with reference to a hollow draft tube, e.g. hollow draft tube 4 of FIG. 1, as in the AGR and LOR approaches referred to herein. It should be noted that it is within the scope of the invention to employ embodiments thereof in which the hollow draft tube is not employed. In such embodiments, the downward pumping impeller means is nevertheless positioned, with respect to the baffle means, so that the baffle means captures most of any undissolved gas that floats to the surface of the liquid following its downward passage, together with liquid rich in dissolved gas, under the downward pumping influence of the impeller means. The use of a draft tube is nevertheless desirable for many applications in enabling power to be efficiently utilized, so that it is not necessary to pump as much liquid as otherwise required, and in precluding undue mixing of solids with the portion of the body of liquid being treated. It will be understood that, in the practice of the various embodiments of the invention, additional baffle means can be provided in the overall system to facilitate the flow of gas and liquid as herein disclosed for the desired gas dissolution purposes of the invention.

From the description and examples above, it will be appreciated that the invention represents a desirable advance in the gas dissolution art as it pertains to the treatment of large bodies of liquid. The invention is particularly advantageous in the safe and efficient dissolution of oxygen in large bodies of liquids in industries such as biotreatment and wastewater treatment. By enabling such treatments to be carried out in-situ and at relatively low pumping power requirements, the invention enhances the technical and economic feasibility of gas dissolution operations in a variety of practical and important industrial processing operations.

What is claimed is:

1. A process for the dissolution of gas in a large uncovered body of liquid system comprising:

(a) providing impeller means positioned below the surface of the large body of liquid, and adapted to cause the passage of a gas-liquid mixture downwardly in said large body of liquid;

(b) providing a hollow draft tube submerged below the surface of said large body of liquid, said, hollow draft tube having open ends at the top and bottom thereof, said impeller means being positioned within the hollow draft tube so that the gas-liquid mixture is caused to pass down in said hollow tube for discharge from the bottom thereof, (c) providing baffle means positioned over said impeller means and of sufficient size to capture most of the undissolved gas that separates from a liquid rich in dissolved gas and floats and to the surface of said large body of liquid for recirculation to said impeller means; and (d) providing conduit means for introducing a feed gas stream beneath said baffle means so that bubbles of the gas are caused by the suction of said impeller means to pass with liquid, as a gas-liquid mixture, downward in said large body of liquid, whereby the liquid rich in dissolved gas, because of the absence of container vessel walls, is dispersed into the large body of liquid, while undissolved gas due to its buoyancy, floats to the surface of said large body of liquid and is captured for recirculation, resulting in essentially complete utilization of the gas stream, the process further comprising energizing the impeller with rotational speed sufficient to cause (i) vortex formation downward from the surface of the liquid above said impeller means such that gas is drawn into and down said draft tube and (ii) turbulence in said draft tube.

2. The process of claim 1 in which in said system, said baffle means is positioned below the surface of said large body of liquid.

3. The process of claim 2 and including means to float or support said baffle means.

4. The process of claim 1 in which said baffle means comprise a flexible balloon canopy.

5. The process of claim 1 in which said baffle means comprise a plastic bubble.

6. The process of claim 1 in which said impeller means comprises an axial flow, down-pumping impeller.

7. The process of claim 1 and including means for monitoring the pressure beneath said baffle means.

8. The process of claim 2 in which said conduit means are adapted to introduce the feed gas stream directly into said large body of liquid directly under or in close proximity to the baffle means.

9. The process of claim 3 in which said baffle means comprise a generally conical shaped, horizontal baffle.

10. The process of claim 9 in which said baffle means is positioned below the surface of said large body of liquid.

11. The process of claim 10 and including means to float or support said baffle means.

12. The process of claim 11 in which said impeller means comprises an axial flow, down-pumping impeller.

* * * * *

UNITED STATES PATENT AND TRADEMARK OFFICE

CERTIFICATE OF CORRECTION

PATENT NO. : 6,135,430
DATED : October 24, 2000
INVENTOR(S) : Bergman, Jr. et al.

It is certified that error appears in the above-identified patent and that said Letters Patent is hereby corrected as shown below:

Title page,
Item [22], insert:

-- Related U.S. Application Data

[63] Continuation of application No. 07/927,711, filed on August 17, 1992, now abandoned. --

Signed and Sealed this

Fifteenth Day of July, 2003

JAMES E. ROGAN
*Director of the United States Patent and Trademark Office*